United States Patent [19]

Dammann et al.

[11] 4,236,323

[45] Dec. 2, 1980

[54] HEATING APPARATUS FOR FALSE TWIST YARN CRIMPING MACHINE

[75] Inventors: Peter Dammann, Remscheid; Benno Frank, Wuppertal-Elberfeld, both of Fed. Rep. of Germany

[73] Assignee: Barmag Barmer Maschinenfabrik Aktiengesellschaft, Remscheid, Fed. Rep. of Germany

[21] Appl. No.: 88,088

[22] Filed: Oct. 24, 1979

[30] Foreign Application Priority Data

Aug. 16, 1979 [DE] Fed. Rep. of Germany ..... 2933087

[51] Int. Cl.[3] ..... F26B 13/02

[52] U.S. Cl. ..... 34/152; 28/272; 57/284; 57/290

[58] Field of Search ..... 165/1; 57/284, 290; 49/246, 247; 34/152, 155, 201; 28/272

[56] References Cited

U.S. PATENT DOCUMENTS

| | | | |
|---|---|---|---|
| 3,379,002 | 4/1968 | Rosenstein | 28/272 |
| 3,802,036 | 4/1974 | Parks | 28/272 |
| 4,058,961 | 11/1977 | Kubler | 57/291 |

FOREIGN PATENT DOCUMENTS

| | | | |
|---|---|---|---|
| 2359913 | 2/1978 | France | 57/284 |

*Primary Examiner*—Larry I. Schwartz

*Attorney, Agent, or Firm*—Bell, Seltzer, Park & Gibson

[57] ABSTRACT

A yarn heating apparatus is provided which is adapted for use in a false twist yarn crimping machine or the like. The heating apparatus comprises an arcuately curved heater plate mounted in a generally vertical orientation within a channel in an insulated housing, and having one or more yarn receiving grooves extending along its length. A flat cover is provided which includes an insert mounted on the inside of the cover, and which is sized to fill substantially the full width of the channel. The cover is hinged to the housing by an arrangement which permits the insertion and withdrawal of the insert along a path of travel which is parallel to the side walls of the channel, to thereby avoid injurious contact between the insert and walls of the channel. The inner face of the insert may be curved in conformance with the curvature of the heater plate, such that when the door is closed, the inner face defines a yarn passage of uniform cross-sectional configuration along the length of the heater plate. During operation of the machine, air rises along the vertically disposed yarn passage as a result of the chimney effect, to carry off the fumes emanating from the heated yarn. The uniform cross-sectional configuration of the passage minimizes heat loss by permitting the laminar flow of such air.

17 Claims, 8 Drawing Figures

HEATING APPARATUS FOR FALSE TWIST YARN CRIMPING MACHINE

False twist yarn crimping machines are conventionally used in the processing of synthetic thermoplastic yarns, and serve to impart "false twist" to the yarn to improve its elasticity and bulk. Typically, such machines subject each of a plurality of running yarns to simultaneous twisting, heat setting, cooling, and untwisting operations, which results in the twist being permanently set into the yarn.

As illustrated for example in the U.S. patent to Kubler, U.S. Pat. No. 4,058,961, a false twist machine normally has a number of working stations along its length, with each station being provided with a heating apparatus for heating one or more running lengths of yarn. Each heating apparatus typically comprises an arcuately curved heater plate having a length of about 1.2 to 1.5 meters and which has one or more longitudinally extending yarn receiving grooves in the outer convex surface thereof. The heater plate is mounted in a channel in a heat insulating housing, and is covered by an insulated flat cover which is hinged to the housing along the length of the channel to permit a yarn to be laterally inserted along the length of each groove.

Since the plate is usually oriented vertically or obliquely on the machine, air flows along the plate as a result of the chimney or stack effect, and absorbs heat from the plate which in turn results in a heat loss. A certain amount of such air flow is necessary however, in order to carry away the fumes of the finish or other chemical agents on the yarn which are vaporized upon the heating of the yarn, and which would otherwise condense and form as a sediment on the surface of the heater plate. Thus the clearance between the plate and cover can not be so small as to preclude adequate air flow for fume removal.

In order to reduce heat loss from the heater plate, it has been previously proposed to position an insert of heat insulating material on the inside of the cover, and such that the insert partially fills the area of the channel above the heater plate when the door is closed. In addition, in one such prior apparatus, the insert has inclined straight inner edge portions adjacent each end so that the insert more completely fills the deeper end portions of the channel which result from the arcuate curvature of the heater plate. Thus while the inner face of the insert may be said to somewhat conform to the arcuate convex face of the heater plate, the cross-sectional configuration of the clearance between the heater plate and insert will be seen to be non-uniform and vary substantially along the length of the plate.

Such prior inserts also have a limited insulating capability in that the width thereof must necessarily be substantially less than the width of the channel in the housing. More particularly, the width of the insert must be less than the width of the channel to preclude engagement with the side wall of the channel during pivotal opening and closing of the cover. Thus the insert does not fill the full width of the channel, and an open, noninsulating gap is formed along each side of the insert.

It is an object of the present invention to reduce and minimize the heat loss from a heater plate of the described type, while providing for sufficient air flow to adequately remove the fumes emanating from the heated yarn.

It is a more particular object of the present invention to provide a yarn heating apparatus of the described type having a heat insulating insert mounted on the inside of the cover and which closely approaches the width of the channel and closely follows the curvature of the heater plate, to thereby minimize heat loss.

These and other objects and advantages of the present invention are achieved by the provision of a yarn heating apparatus which comprises a heat insulating housing having a channel in the front face, an elongate heater plate having at least one longitudinally extending yarn receiving groove in one face, and with the heater plate being disposed in the channel so as to be in spaced relation from the front face of the housing and with the yarn receiving groove facing outwardly from the channel. A cover is also provided which comprises a supporting plate and an insulating insert mounted on one side of the plate and having a width closely approaching the width of the channel. The cover is mounted to the housing by hinge means which guide the cover for initial movement within a plane parallel to the side walls of the channel and then in a lateral direction when the cover is opened. When the cover is closed, the cover is moved in a reverse sequence of like movements. By this arrangement, the insert, which is typically fabricated from a relatively soft material, is withdrawn from and inserted into the channel along a direction parallel to the side walls of the channel, and so as not to injuriously contact the walls.

As a further aspect of the present invention, the inner face of the insert may be curved along its length in conformance with the curvature of the heater plate, such that the yarn passage between the heater plate and insert is uniform along the length of the plate. This results in laminar air flow conditions along the passage, which reduces the heat absorbed by the air as compared to turbulent flow. As noted above, in the described prior heating apparatus, this passage was non-uniform, causing turbulent flow and which in turn resulted in the air absorbing additional heat.

Some of the objects having been stated, other objects will appear as the description proceeds, when taken in connection with the accompanying drawings in which.

Figure 1:
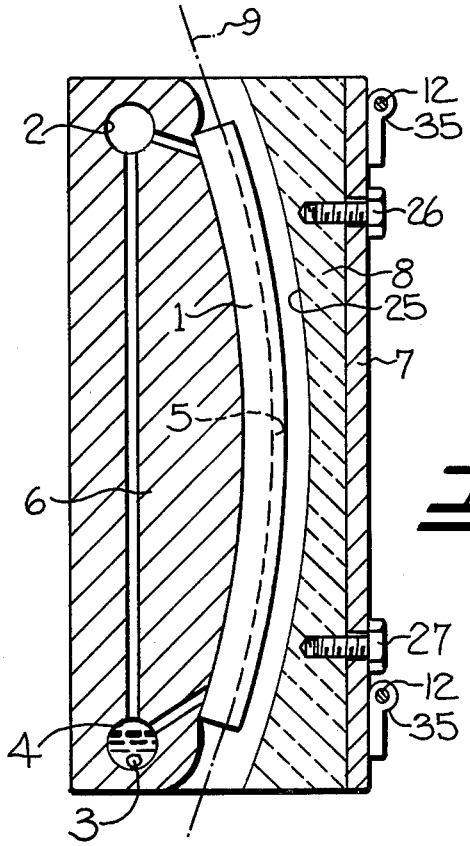
FIG. 1 is a schematic sectional side elevation view through a yarn heating apparatus which embodies the present invention.
Figure 2:
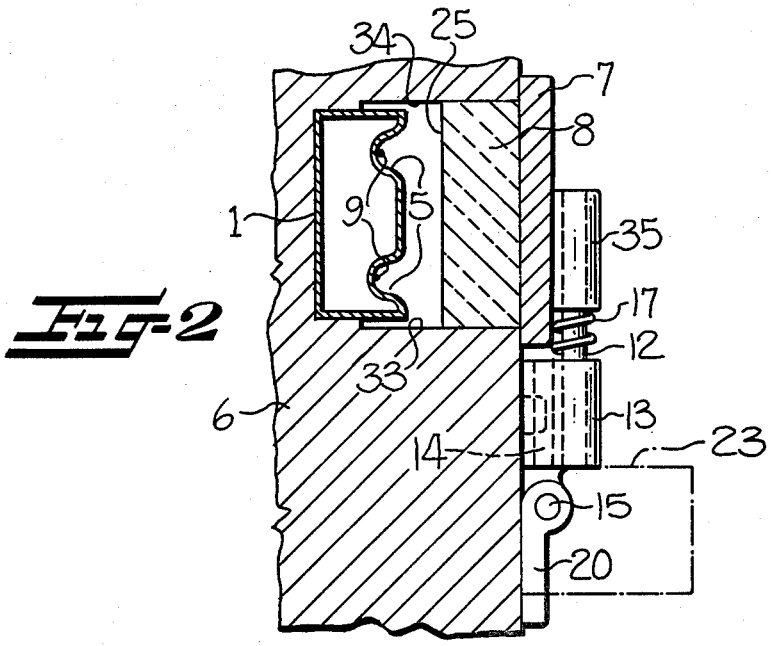
FIG. 2 is a sectional plan view of the heater shown in FIG. 1.

Referring more specifically to the drawings, FIGS. 1–4 illustrate one embodiment of a yarn heating apparatus which embodies the present invention. In this regard, it will be understood by those skilled in the art that a number of such apparatus may be mounted in a side-by-side arrangement on an otherwise conventional false twist yarn crimping machine or the like, and with each heating apparatus being oriented in a generally vertical or oblique direction.

The yarn heating apparatus as illustrated in FIGS. 1–4 comprises a heat insulating housing 6 having an elongate channel formed in the front face thereof. The channel has a generally U-shaped cross-sectional configuration which defines a bottom wall and opposite, generally parallel side walls 33, 34. The housing is preferably filled with a suitable insulating material, such as glass wool.

An elongate heater plate 1 is mounted within the channel of the housing. The plate has a uniform arcuate curvature in the longitudinal direction, and is provided with two longitudinally extending grooves 5 in the outer convex surface thereof, with each groove being adapted to receive a yarn 9. The plate is disposed in the channel with the convex surface and the yarn receiving grooves facing outwardly. As illustrated, the heater plate is part of a tube, the ends of which are connected to ducts 2 and 4 which extend in a horizontal direction along the false twist machine. A heater element 3 is located in the lower duct 4 which heats and vaporizes a liquid, and the rising vapor condenses in the tube behind the heater plate and thereby elevates the temperature of the plate to the desired level in a conventional manner.

The apparatus further comprises an elongate cover 7 which includes a flat supporting plate and an insulating insert 8 mounted on one side of the plate. The insert 8 is typically formed of a relatively soft heating insulating material, and it may be hollow. Also, the insert has a length conforming to the length of the channel and has a generally rectangular cross-sectional configuration which defines an inner face 25 and parallel side edges which are spaced apart a distance which closely approaches the distance between the side walls 33, 34 of the channel, note FIG. 2. Also, the inner face 25 of the insert is arcuately curved along its length in conformance with the curvature of the convex face of the heater plate and has a width sufficient to span the yarn receiving grooves 5. The conforming curvature of the inner face of the insert results in a passage of uniform cross-sectional configuration between the heater plate and insert along the full length of the plate. Also, the insert 8 is mounted to the supporting plate by means of the threaded members 26 and 27, to permit the extent and orientation of the passage to be adjusted.

In accordance with the present invention, the cover 7 is mounted to the housing by hinge means which acts to sequentially guide the cover for movement within a plane parallel to the side walls 33, 34 of the channel to withdraw the insert from the channel, and then for lateral movement, when the cover is moved from the closed position to the open position. When the cover is closed, the sequence is reversed, thereby resulting in the insert being both withdrawn from and inserted into the channel along a path of travel which is perpendicular to the channel and parallel to its side walls. By this arrangement, the insert may be sized to closely conform to the channel to provide maximum insulating effect, without risking possibly injurious contact between the channel and insert during opening or closing of the cover.

Figure 3:
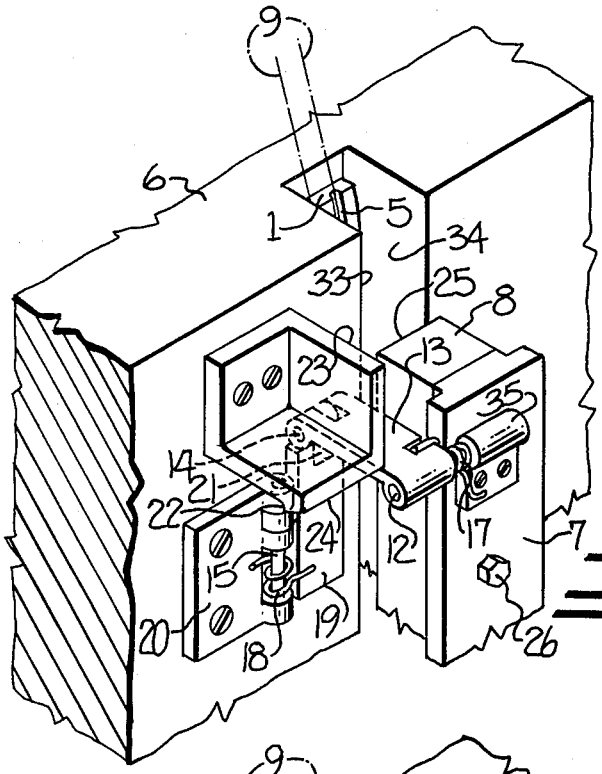
FIG. 3 is a fragmentary perspective view of the heater, with the cover in a partially open position.
Figure 4:
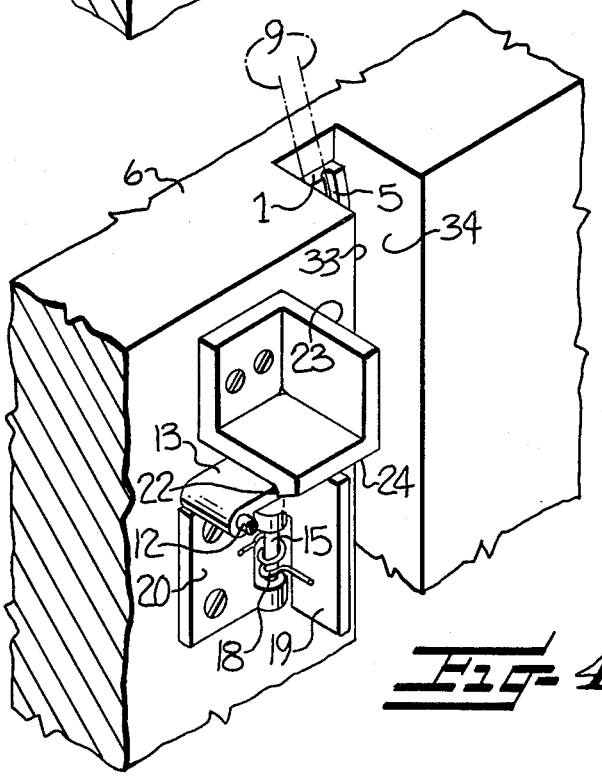
FIG. 4 is similar to FIG. 3 but illustrating the fully open position.

In the illustrated embodiment, this hinge means comprises a pair of double acting hinges which are spaced apart along the length of the cover. Each hinge comprises a first hinge plate 20 fixed to the housing, a second hinge plate 35 fixed to the cover, a third hinge plate 19 pivotally connected to the first plate by a pin 15 which defines a first axis which is parallel to the longitudinal direction of the channel, and a fourth hinge plate 13 which is pivotally connected at one end thereof to the third hinge plate 19 for pivotal movement about a pin 14 which defines a second axis disposed perpendicular to the first axis and parallel to the front face of the housing when the cover is closed as well as when the cover is moved to its partially open position as seen in FIG. 3. The other end of the plate 13 is pivotally connected to the second hinge plate 35 for pivotal movement about a pin 12 which defines a third axis which is parallel to the second axis. The fourth hinge plate 13 mounts a shoulder stop 21 for the purposes described below.

Each hinge further includes a guide plate which assures the above described sequence of movements. The guide plate is mounted to the housing and includes a vertical guide surface 23 which is disposed perpendicular to the front face of the housing and adjacent the fourth hinge plate 13. Also, the guide plate includes a horizontal guide surface 24 which is perpendicular to the vertical surface 23 and is disposed at a level slightly above the pin 14. A latch 22 is formed adjacent the front edge of the horizontal surface 24 for the purposes to be described. Spring biasing means is also provided for biasing the hinge plates toward the closed position of the cover. This biasing means comprises a helical spring 18 operatively disposed about the pin 15, and a second helical spring 17 operatively disposed about the pin 12.

To describe the opening and closing sequence in more detail, it will be observed that when the cover is in its closed position, the four hinge plates are substantially co-planar, with the fourth plate 13 being disposed above the third plate 19. Upon initial outward movement of the cover, the fourth hinge plate pivots toward an upright position. During this initial movement, the vertical guide surface 23 is in contact with the edge of the fourth guide plate 13 to preclude any pivoting movement about the axis of pin 15. Thus the cover is withdrawn from the channel along a path of travel within a plane parallel to the side walls of the channel.

Upon the fourth hinge plate reaching the fully upright position as shown in FIG. 3, the fourth hinge plate will be disposed below the horizontal guide surface 24, whereby the third and fourth hinge plates and cover may all be pivoted about the axis of pin 15 to the fully open position. In this regard, it will be noted that the weight of the cover will tend to pivot the fourth hinge plate beyond an upright position, but such further movement is precluded by the shoulder 21 abutting the surface of the hinge plate 19. When the fully open position is reached, the fourth hinge plate is caught behind the latch 22 to thereby preclude inadvertent reverse pivotal movement, note FIG. 4.

To close the cover, the latch 22 is manually released, and the cover is initially pivoted about the axis of pin 15 to the position shown in FIG. 3. The cover is then translated into the channel, with the fourth hinge plate pivoting upwardly about the axis of pin 14. In this regard, it will be noted that the spring 17 tends to compensate for the weight of the cover in the closed position, to prevent the weight of the cover from causing the same to withdraw from the channel.

Figure 5:
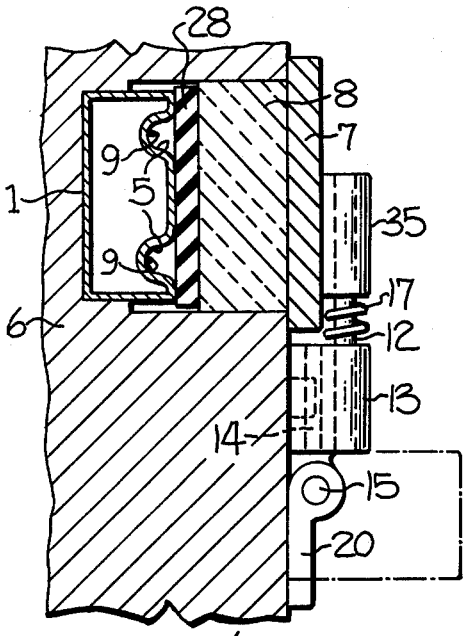
FIG. 5 is a sectional plan view of a modified form of the invention.
Figure 6:
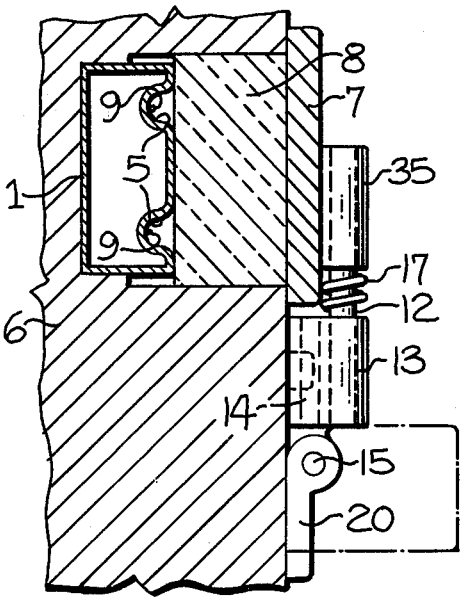
FIG. 6 is a sectional plan view of still another form of the invention.

In the embodiment shown in FIG. 5, a flat sealing strip 28 is mounted to the inner face of the insert, and is configured to directly contact the convex face of the heater plate when the cover is closed, to effectively seal each yarn receiving groove and further reduce heat loss. The sealing strip 28 may be formed from a suitable resilient and heat resistant polymeric material, such as Teflon or silicone. In the embodiment of FIG. 6, a similar seal is effected by sizing the insert itself to directly and conformingly contact the face of the heater plate.

Figure 7:
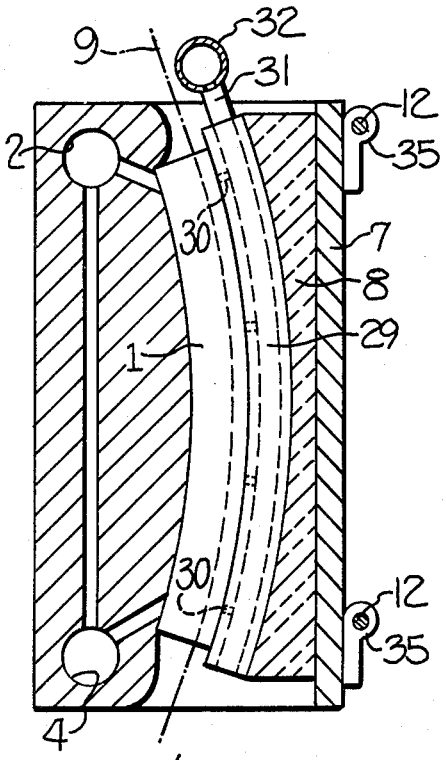
FIG. 7 is a sectional side elevation view of a further embodiment, and wherein the heating apparatus includes a fume removal system.
Figure 8:
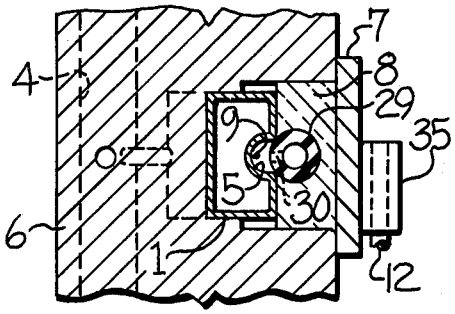
FIG. 8 is a sectional plan view of the embodiment shown in FIG. 7.

In the embodiment of FIGS. 7 and 8, the sealing member is in the form of a resilient tubular member 29, and includes a plurality of apertures 30 spaced along its length, which communicate between the interior of the tubular member and the closed yarn passage when the door is closed. The tubular member 29 is suitably closed at its lower end, and its upper end is connected to a duct 31 which leads to a collection duct 32. Collection duct 32 connects all ducts 31 of the false twist machine to a pump (not shown) which can be used to draw a partial vacuum in the collection duct 32, causing the fumes emanating from the heated yarn to be withdrawn from the yarn passage through the apertures 30, tubular member 29, and duct 31. In addition, it is contemplated that a closed cavity may be formed within the insert of the embodiments of FIGS. 1–6, which can be similarly connected to a duct system, to facilitate fume removal.

From the above description, it will be observed that the substantially uniform cross-sectional configuration of the closed yarn passage permits the air to move along the passage under laminar flow conditions, which minimizes the heat absorbed by the air and thus heat loss. Further, by sealably covering the yarn receiving groove, the seal acts to minimize heat loss from radiation.

In the drawings and specification, there has been set forth a preferred embodiment of the invention, and although specific terms are employed, they are used in a generic and descriptive sense only and not for purposes of limitation.

That which is claimed is:

1. A yarn heating apparatus for use in a false twist yarn crimping machine or the like and comprising a heat insulating housing having a front face and an elongate channel in said front face, said channel having a generally U-shaped cross-sectional configuration which defines a bottom wall and opposite, generally parallel side walls, an elongate heater plate disposed along said bottom wall in said channel so as to be in spaced relation from said front face of said housing, heating means operatively connected to said heater plate for elevating the temperature thereof, an elongate cover including an insert, said insert having a length conforming to the length of said channel and having a generally rectangular cross-sectional configuration and parallel side edges which are spaced apart a distance which closely approaches the distance between said side walls of said channel, means mounting said cover to said housing for movement between a closed position wherein said insert is disposed within said channel, and an open position spaced from said housing, said mounting means including hinge means for sequentially guiding said cover for movement within a plane parallel to said side walls of said channel to withdraw said insert from said channel and then guiding the cover for movement in a lateral direction when said cover is moved from said closed to said open position, and for moving said cover in a reverse sequence of like movements when the same is moved from said open to said closed position.

2. The yarn heating apparatus as defined in claim 1 wherein said hinge means comprises at least one double acting hinge interconnecting said cover and housing, and whereby the cover is guided in said planar movement by the pivoting of each hinge about an axis perpendicular to the longitudinal direction of said channel during initial opening and final closing of said cover, and is guided in said lateral movement by the pivoting of each hinge about an axis generally parallel to the longitudinal direction of said channel during final opening and initial closing of said cover.

3. The yarn heating apparatus as defined in claim 2 wherein each hinge comprises a first hinge plate fixed to said housing, a second hinge plate fixed to said cover means, a third hinge plate pivotally connected to said first hinge plate for pivotal movement about a first axis extending parallel to the longitudinal direction of said housing channel, and a fourth hinge plate pivotally connected at one end thereof to said third hinge plate for pivotal movement about a second axis disposed perpendicular to said first axis, the other end of said fourth hinge plate being pivotally connected to said second hinge plate for pivotal movement about a third axis which is parallel to said second axis.

4. The yarn heating apparatus as defined in claim 3 wherein said four hinge plates are substantially co-planar when said cover means is closed, and wherein said fourth hinge plate is adapted to pivot between an initial co-planar position to an upright position with respect to the remaining hinge plates to effect said planar movement of said cover.

5. The yarn heating apparatus as defined in claim 4 wherein said hinge means further comprising guide plate surface means fixed to said housing for operatively contacting said fourth hinge plate during its pivotal movement between said initial co-planar position and a point just short of said upright position, and thereby precluding pivotal movement between said first and third hinge plates about said first axis during such pivotal movement, whereby said fourth hinge plate pivots about said second axis during initial opening and final closing of said cover means, and said third hinge plate pivots about said first axis during final opening and initial closing of said cover means.

6. The yarn heating apparatus as defined in claim 5 wherein said heating apparatus is disposed in a vertical or oblique orientation, and said fourth hinge plate is disposed above said third hinge plate in said co-planar position when said cover means is closed, whereby said fourth hinge plate pivots downwardly during initial opening of said cover means, and whereby the weight of said cover tends to bias said fourth hinge plate toward such downward pivotal movement.

7. The yarn heating apparatus as defined in claim 4 further comprising shoulder means mounted on one of said third and fourth hinge plates for limiting the downward pivotal movement of said fourth hinge plate during opening of said door means to said upright position and for holding said fourth hinge plate in said upright position against the weight of said cover.

8. The yarn heating apparatus as defined in claim 7 further comprising latch means fixed to said housing for releasably engaging said fourth hinge plate upon said cover being fully opened to thereby preclude inadvertant relative pivotal movement between said first and third hinge plates at such position.

9. The yarn heating apparatus as defined in claim 8 further comprising spring biasing means for biasing said first and third hinge plates toward relative rotation about said first axis in a direction toward said co-planar position, and for biasing said second and fourth hinge plates toward relative rotation about said third axis in a direction toward said co-planar position, whereby said spring biasing means acts to at least partially compensate for the weight of said cover tending to withdraw the same from the channel.

10. The yarn heating apparatus as defined in claim 1 wherein said insert comprises a relatively soft heat insulating material.

11. The yarn heating apparatus as defined in claim 1 further comprising means for withdrawing the fumes emanating from a heated yarn passing along said heater plate and comprising cavity means positioned between said cover plate and the inner face of said insert, and extending longitudinally along substantially the full length of said insert, a plurality of longitudinally spaced apart apertures extending through the inner face of said insert and communicating between said passage and said cavity means when said cover is closed, and duct means operatively connected to the interior of said cavity means for withdrawing air therefrom, whereby air and the fumes emanating from the heated yarn may be withdrawn through said apertures and cavity means.

12. A yarn heating apparatus for use in a false twist yarn crimping machine or the like and comprising a heat insulating housing having a front face and an elongate channel in said front face, said channel having a generally U-shaped cross-sectional configuration which defines a bottom wall and opposite, generally parallel side walls, an elongate heater plate having a uniform arcuate curvature along its length and at least one longitudinally extending yarn receiving groove in the convex face thereof, said heater plate being disposed along said bottom wall in said channel so as to be in spaced relation from said front face of said housing and with said convex face and said yarn receiving groove facing outwardly from said channel, heating means operatively connected to said heater plate for elevating the temperature thereof, an elongate cover comprising a supporting plate and an insert mounted to one side of said supporting plate, said insert having a length conforming to the length of said channel and having a generally rectangular cross-sectional configuration which defines an inner face and parallel side edges which are spaced apart a distance which closely approaches the distance between said side walls of said channel, said insert further having an inner face which is arcuately curved along its length in conformance with the curvature of the convex face of said heater plate and a width sufficient to span each yarn receiving groove, means mounting said cover to said housing for movement between a closed position wherein said plate is disposed adjacent said housing front face with said insert disposed within said channel and with said inner face of said insert being disposed uniformly with respect to said convex face of said heater plate to define a yarn passage of substantially uniform cross-sectional configuration along the length of said heater plate, and an open position spaced from said housing, said mounting means including hinge means for sequentially guiding said cover for movement within a plane parallel to said side walls of said channel to withdraw said insert from said channel and then for pivotal movement about an axis extending generally parallel to the longitudinal direction of said channel when said cover is moved from said closed to said open position, and for reversely pivoting and linearly guiding said cover when the same is moved from said open to said closed position.

13. The yarn heating apparatus as defined in claim 12 wherein said inner face of said insert directly contacts the convex face of said heater plate when said cover is closed, to effectively seal each yarn receiving groove.

14. The yarn heating apparatus as defined in claim 10 further comprising a resilient and heat resistant sealing member mounted to the inner face of said insert, and such that said sealing member directly contacts the convex face of said heater plate when said cover is closed, to effectively seal each yarn receiving groove.

15. The yarn heating apparatus as defined in claim 14 wherein said sealing member is tubular and includes a plurality of apertures spaced along its length and communicating with each yarn receiving groove when said cover means is closed.

16. The yarn heating apparatus as defined in claim 15 further comprising duct means operatively connected to the interior of said tubular sealing member for conveying air through said tubular member and apertures to effect fume removal.

17. The yarn heating apparatus as defined in claim 20 wherein said cover further comprises means adjustably mounting said insert to said supporting plate, to permit the positioning of said insert to be adjusted with respect to said heater plate when said cover means is closed.

* * * * *